United States Patent [19]

Hellman et al.

[11] Patent Number: 5,050,502

[45] Date of Patent: Sep. 24, 1991

[54] AMMUNITION UNIT HAVING A SLEEVE ON A PRIMER TUBE

[75] Inventors: Ulf Hellman; Christer Sundell, both of Karlskoga, Sweden

[73] Assignee: Aktiebolaget Bofors, Bofors, Sweden

[21] Appl. No.: 487,118

[22] Filed: Mar. 2, 1990

[30] Foreign Application Priority Data

Mar. 2, 1989 [SE] Sweden ..... 8900718

[51] Int. Cl.[5] ..... E42B 5/02

[52] U.S. Cl. ..... 102/430; 102/470; 102/513

[58] Field of Search ..... 102/430, 431, 464, 469, 102/470, 513, 439

[56] References Cited

U.S. PATENT DOCUMENTS

| | | | |
|---|---|---|---|
| 4,103,620 | 8/1978 | Rusbach | 102/513 |
| 4,763,577 | 8/1988 | Romer et al. | 102/430 |
| 4,938,145 | 7/1990 | Martwick | 102/430 |

FOREIGN PATENT DOCUMENTS 1535733 12/1978 United Kingdom .

*Primary Examiner*—Harold J. Tudor

*Attorney, Agent, or Firm*—Pollock, Vande Sande & Priddy

[57] ABSTRACT

An apparatus is provided for a primer for igniting a propellant charge of an ammunition unit which includes a cartridge case, a shell located in the forward end of the cartridge case, a tracer cartridge secured to the rear surface of the shell, a propellant charge in the cartridge case, a primer having an elongate primer tube extending in the case through the propellant charge and a space defined in the longitudinal direction of the case between the tracer cartridge and the primer tube. The apparatus comprises a sleeve member having a first end portion mounted onto a forward end of the primer tube and a second end portion adapted to be applied over the tracer cartridge and a partition member provided inside the sleeve member intermediate the end portions for preventing displacement of the sleeve member with respect to the primer tube and therefore preventing collision between the tracer cartridge and the primer tube.

7 Claims, 2 Drawing Sheets

AMMUNITION UNIT HAVING A SLEEVE ON A PRIMER TUBE

TECHNICAL FIELD

The present invention relates to an apparatus in a primer of the type which is disposed in the cartridge case of a shell or other projectile for igniting the propellant charge of the cartridge case. The primer includes a sleeve-shaped portion disposed in the rear plane of the cartridge case and an elongate tube which extends centrally through the propellant charge of the cartridge case forwardly towards the rear plane of the projectile. The tube is provided with a number of outlet apertures for igniting the surrounding propellant charge at a plurality of points along its longitudinal direction. A primer of this type is previously known from, for instance, Swedish Patent No. 7414990-7.

BACKGROUND ART

In drop tests against the rear plane of the cartridge case in ammunition units of the above-disclosed type, it has proved that the shell shows a tendency to slide into the cartridge case. Neither the crimp-and-groove union nor the bourrelet of the shell is capable of resisting the shell. The risk of collision between a tracer cartridge mounted on the rear plane of the shell and the primer is obvious. Such a collision will result in ignition of the tracer cartridge, which may have serious consequences in connection with ammunition handling.

SUMMARY OF THE INVENTION

The object of the present invention is to realize an apparatus which prevents collision between the primer and a tracer cartridge disposed on the rear plane of the shell. According to the present invention the portion of the tube of the primer adjacent the rear plane of the shell is provided with an extension sleeve which extends forwardly such that the forward region of the sleeve surrounds the tracer cartridge. The point of collision in the event of a jolt against the rear plane of the cartridge case will then instead be located between the extension sleeve and the rear plane of the shell so that the tracer cartridge remains undamaged.

According to one advantageous embodiment of the present invention, the extension sleeve is slightly conical with its broader portion facing towards the rear plane of the shell and provided with a number of apertures or slots which serve as ports for the gas flow from the powder in the propellant charge towards the tracer cartridge.

BRIEF DESCRIPTION OF THE ACCOMPANYING DRAWINGS

The nature of the present invention and its aspects will be more readily understood from the following brief description of the accompanying Drawings, an discussion relating thereto.

DETAILED DESCRIPTION OF PREFERRED EMBODIMENT

Figure 1:
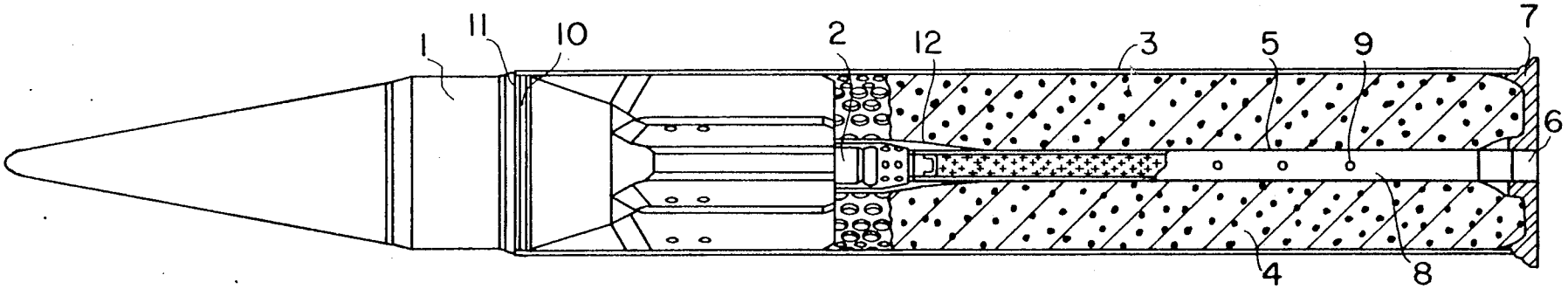
FIG. 1 shows a complete round in the form of a shell with tracer cartridge and cartridge cases.

Referring to the Drawings, FIG. 1 shows an ammunition unit in the form of a complete round which comprises a fin-stabilized armor-piercing shell 1 with tracer cartridge 2 and cartridge case 3. These parts are known in the art and will not, therefore, be described in greater detail here.

For igniting the propellant charge 4 of the cartridge case 5, a primer 5 is disposed in the cartridge case 3. The primer 5 consist of two main parts: a primer sleeve 6 disposed in the rear plane 7 of the cartridge case and an elongate tube 8 which extends centrally through the propellant charge 4. The primer sleeve carries ignition devices, for example a conventional percussion cap and ignition charge, and the elongate tube 8 forms a combustion chamber which is provided with a number of outlet apertures 9 throughout its entire length, through which a simultaneous and rapid ignition may be effected at a plurality of points of the surrounding propellant charge. In this respect, the primer is wholly conventional and will not be described in greater detail here.

As was mentioned by way of introduction, it has proved in drop tests against the rear plane of cartridge cases of the above-described type that the shell shows a marked tendency to slide into the cartridge case. While the shell is connected, by a crimp and groove union 10, to the cartridge case, neither this union nor the bourrelet 11 of the shell is capable of resisting the shell in the event of powerful jolts against the rear plane. The risk of collision between the tracer cartridge 2 and the forward region of the primer tube is obvious. The risk of accidents is extremely high, since the tracer cartridge may be ignited as a result of this collision, which could lead to serious consequences.

To prevent collision between the tracer cartridge 2 and the primer 5, an extension sleeve 12 is disposed on the forward portion of the primer tube. The forward portion of the primer tube is provided with an external thread on which the rear portion 13 of the sleeve is fixedly threaded. The forward portion 14 of the sleeve extends up to the rear plane 15 of the shell proper and surrounds the tracer cartridge 2. Ideally, the sleeve is disposed such that a narrow gap 16 is left between the forward edge 17 of the sleeve and the rear plane 15. The sleeve is slightly conical, tapering rearwardly, and merges forwardly in a cylindrical portion about the tracer cartridge.

Figure 4:
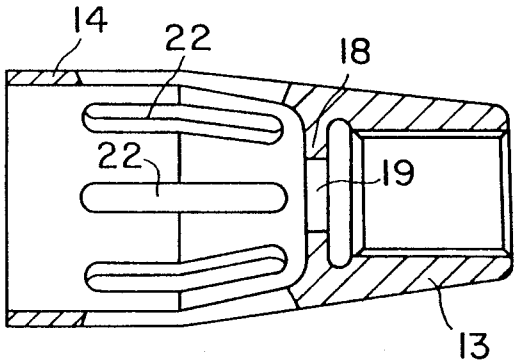
FIG. 4 shows an alternative design of the sleeve.

The extension sleeve 12 is provided with a partition 18 which separates the rear portion of the sleeve which surrrounds the end portion of the primer tube, and the forward portion of the sleeve. The partition is provided with a central through aperture 19. At least in the region between the rear plane 20 of the tracer cartridge and the partition, the wall of the extension sleeve is perforated with a number of holes 20 which allow the gas flow from the powder of the propellant charge to impinge upon the tracer cartridge such that this is ignited. Instead of being provided with a number of holes 21, the sleeve may be provided with through-slots 22, see FIG. 4. In such instance, the gas flow from the powder is aimed directly towards the seal of the tracer cartridge and makes for a more efficient ignition of the tracer cartridge.

Figure 5:
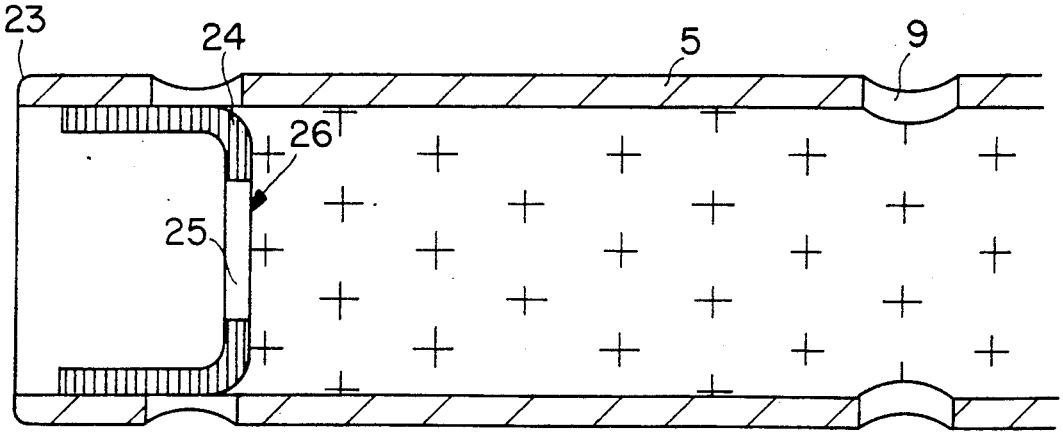
FIG. 5 shows the forward region of the primer tube in detail.

The forward edge 23 of the primer tube abuts against the partition which thereby prevents the sleeve from being displaced in relation to the primer, see FIG. 5.

Figure 3:
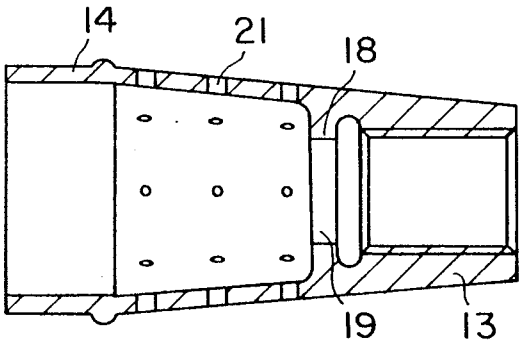
FIG. 3 shows a first variant of the extension sleeve.
Figure 2:
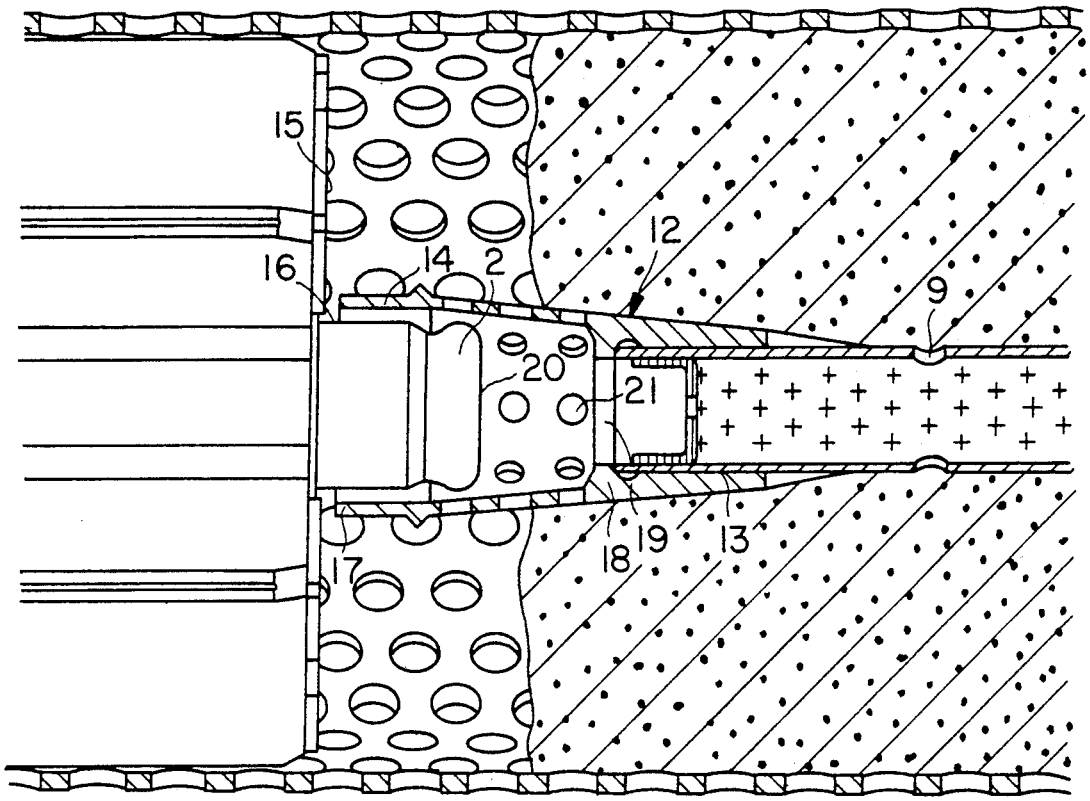
FIG. 2 shows, on a larger scale, a portion of the round.

The forward region of the primer is provided with a cardboard case 24 (a diaphragm) for sealing purposes. The cardboard case is weakened at reference numeral 25 so as to provide an area of fracture. In this instance, a certain assistance may be obtained from the primer in that combustion gases are allowed to flow through the weakened portion 25 and the opening 19 of the partition to the tracer cartridge and ignite it. The weakened portion 25 is normally covered by a thin aluminium foil 26 or the like. On ignition, an earlier occurrence which has happened in this art is that the cardboard case 24 was thrown forwards towards the tracer cartridge and deposited itself over the tracer as a cap, thereby impending complete ignition. According to the present invention, the cardboard case is entrapped by the partition of the extension sleeve and is prevented from depositing itself on the tracer cartridge. In the embodiment according to FIG. 4, the central through-opening 19 is therefore of slightly smaller diameter than in the embodiment illustrated in FIG. 3.

The present invention should not be considered as restricted to that described above and shown on the Drawings, many modifications being conceivable without departing from the spirit and scope of the appended claims.

What we claim and desire to secure by Letters Patent is:

1. An ammunition unit comprising a cartridge case, a shell having a rear surface and located in the forward end of the cartridge case; a tracer cartridge secured to the rear surface of the shell, a propellant charge in the cartridge case, a primer having an elongate primer tube extending in the cartridge case through the propellant charge and a space defined in the longitudinal direction of the case between the tracer cartridge and a forward portion of the primer tube, a sleeve member having a first end portion mounted onto the forward portion of the primer tube and a second end portion surrounding and spaced from the tracer cartridge and a partition member projecting inwardly inside said sleeve member intermediate said end portions for preventing longitudinal displacement of said sleeve member with respect to the primer tube and therefore preventing collision between the tracer cartridge and the primer tube.

2. The ammunition unit to claim 1, wherein said sleeve member is slightly conical with its broader portion facing towards a rear end plane of the shell, and its forward edge extending substantially towards the rear end of the shell and terminates at a small distance therefrom.

3. The ammunition unit as claimed in claim 2, wherein the forward portion of said sleeve member is, at least between said partition member and a rear end of the tracer cartridge, perforated with a plurality of holes for allowing combustion gases from the surrounding propellant charge to reach the tracer cartridge.

4. The ammunition unit as claimed in claim 2, wherein the forward portion of said sleeve member is, at least between said partition member and a rear end of the tracer cartridge, perforated with a plurality of slots for allowing combustion gases from the surrounding propellant charge to reach the tracer cartridge.

5. The ammunition unit according to claim 3, wherein the forward edge of the primer tube abuts against said partition member.

6. The ammunition unit according to claim 3, wherein the forward portion of the primer tube is provided with a sealing case of cardboard or similar material, said sealing case being provided with a weakened portion for creating an area of fracture and permitting combustion gases from the primer to reach the tracer cartridge through an opening in said partition member.

7. The ammunition according to claim 1, wherein said partition member defines a central opening therethrough.

* * * * *